US006334565B1

(12) United States Patent
Berrigan

(10) Patent No.: US 6,334,565 B1
(45) Date of Patent: Jan. 1, 2002

(54) CONVEYING A RECORDING MEDIUM

(75) Inventor: John W. Berrigan, Nashua, NH (US)

(73) Assignee: ECRM, Inc., Tewksbury, MA (US)

( * ) Notice: Subject to any disclaimer, the term of this patent is extended or adjusted under 35 U.S.C. 154(b) by 0 days.

(21) Appl. No.: 09/419,464

(22) Filed: Oct. 15, 1999

(51) Int. Cl.[7] ..... B65H 20/00
(52) U.S. Cl. ..... 226/176; 226/187
(58) Field of Search ..... 226/176, 177, 226/174, 187

(56) References Cited

U.S. PATENT DOCUMENTS 3,148,819 * 9/1964 Frick et al. ..... 226/176
3,257,056 * 6/1966 Cederberg et al. ..... 226/176
3,572,571 * 3/1971 Mori ..... 226/176
3,669,331 * 6/1972 Renold ..... 226/176
5,129,749 * 7/1992 Sato ..... 226/187 X
5,913,470 * 6/1999 Scribner ..... 226/187 X

* cited by examiner

*Primary Examiner*—Michael R. Mansen
(74) *Attorney, Agent, or Firm*—Hale and Dorr LLP

(57) ABSTRACT

An apparatus for conveying a recording medium includes first and second rollers which define a common area through which the recording medium is conveyed. The first and second rollers contact the recording medium in the common area and rotate in concert to convey the recording medium from the common area. A cam leverages the second roller to vary an amount of nonzero force applied to the recording medium in the common area.

16 Claims, 5 Drawing Sheets

CONVEYING A RECORDING MEDIUM

BACKGROUND OF THE INVENTION

This invention relates to conveying a recording medium and, more particularly, to varying an amount of force applied to the recording medium by conveying rollers.

Recording media is conveyed using rollers which "pinch" the media to move it to/from an imaging location. Heretofore, the same amount of pinch force was applied by the rollers to convey media regardless of the thickness (and thus the stiffness) of the media. This can result in poorly formed images since different amounts of force may be required to accurately convey "thin" media (on the order of 0.004 inches thick) than to accurately convey "thick" media (on the order of 0.007 to 0.008 inches thick).

SUMMARY OF THE INVENTION

In general, in one aspect, the invention features an apparatus which conveys a recording medium. The apparatus includes first and second rollers that define a common area through which the recording medium is conveyed. The first and second rollers contact the recording medium in the common area and rotate in concert to convey the recording medium from the common area. A cam leverages the second roller to vary an amount of nonzero force applied to the recording medium in the common area.

Among the advantages of the invention may be one or more of the following. By leveraging the second roller, it is possible to vary the amount of force applied to the recording medium based, for example, on the thickness of the recording medium. Thus, when used with an imaging apparatus, the invention makes it possible to form accurate images on recording media of different thicknesses.

This aspect of the invention may include one or more of the following features. The common area is defined by surfaces of the first and second rollers. The cam may be movable into plural positions, each of which leverages the second roller differently to change the amount of force. The apparatus may include a bar arranged in a common mechanical coupling with the second roller. The cam is in contact with the bar and is movable relative to the bar to leverage the second roller. The first roller may be a capstan roller and the second roller may be a pinch roller.

The apparatus may include a control mechanism for controlling the cam to leverage the second roller. The control mechanism comprises a first gear connected to the cam, a second gear connected to the first gear by a belt which couples motion of the first gear to the second gear, and a lever which mates to a receptacle in the second gear and which is movable to control motion of the second gear. The second gear may include plural receptacles. The lever is capable of mating to each of these receptacles. The lever controls motion of the second gear to apply a first range of force when mated to a first one of the plural receptacles. The lever controls motion of the second gear to apply a second range of force when mated to a second one of the plural receptacles. The apparatus may include mechanical stops arranged relative to the lever for limiting a range of motion of the lever.

The apparatus may include a member which is in a common mechanical coupling with plural pinch rollers (including the second roller) and a bar which couples to the member and which is in contact with the cam. The cam is rotatable relative to the bar to leverage the plural pinch rollers via the bar and the member. The apparatus may include a second cam on an opposite side of the member from the first cam, and a second bar which couples to the member and which is in contact with the second cam. The second cam is rotatable relative to the second bar to leverage the plural pinch rollers via the second bar and the member.

The apparatus may include a mounting block which is coupled to the second roller, a member which is coupled to the mounting block, and a bar which is coupled to the member and which is in contact with the cam. The cam is rotatable relative to the bar to leverage the second roller via the bar, the member, and the mounting block. The mounting block may include a spring in contact with the member and the second roller for controlling motion of the second roller during leveraging. The apparatus may be part of a laser imaging system.

In general, in another aspect, the invention features an apparatus for conveying a recording medium. The apparatus includes conveying means for conveying the recording medium. The conveying means applies an amount of force to the recording medium during conveying. Changing means changes the amount of force. Among the features that may be included in the invention is a controlling means for controlling the changing means manually.

Other features and advantages of the invention will become apparent from the following description and claims.

DESCRIPTION OF THE PREFERRED EMBODIMENT

Figure 1:
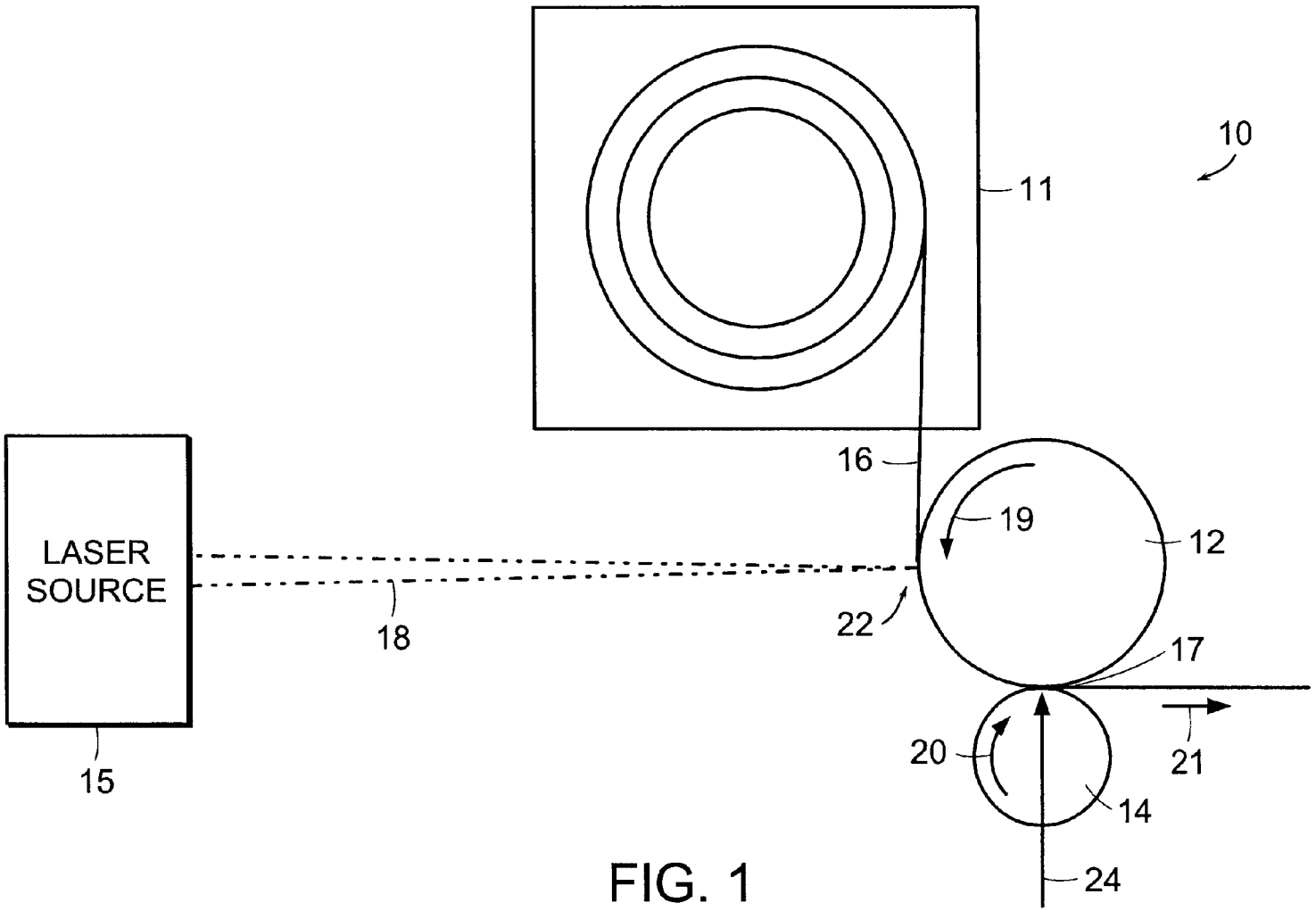
FIG. 1 is a side view of a laser imaging system.

FIG. 1 shows a laser imaging system 10. Laser imaging system 10 includes media supply 11, capstan roller 12, pinch roller 14, and a laser source 15. System 10 also include electronics (not shown) for controlling the motion of rollers 12 and 14 and optics (not shown) for controlling scanning of laser beam 18 to form images on medium 16.

In operation, recording medium 16 is loaded, from media supply 11, to a common area 17 between the surfaces of capstan roller 12 and pinch roller 14. Recording medium 16 may be any type of medium; however, photosensitive metal film is used in this embodiment. Rollers 12 and 14 contact recording medium 16 in common area 17 and rotate in concert (in the directions of arrows 19 and 20) to convey recording medium 16 away from common area 17 (in the direction of arrow 21). While recording medium 16 is being conveyed in this manner, laser beam 18 is scanned over its surface roughly at plane 22, thereby exposing recording medium 16. This exposure changes properties of the recording medium 16 which, when further processed, results in the formation of an image at the points of exposure.

During conveying, a pinch force (in the direction of arrow 24) is provided to recording medium 16 by pinch roller 14. Pinch roller 14 is leveraged (i.e., moved) relative to capstan roller 12 (which remains substantially immobile) to vary the amount of this pinch force. Mechanisms for controlling the movement of pinch roller 14 are as follows.

Figure 2:
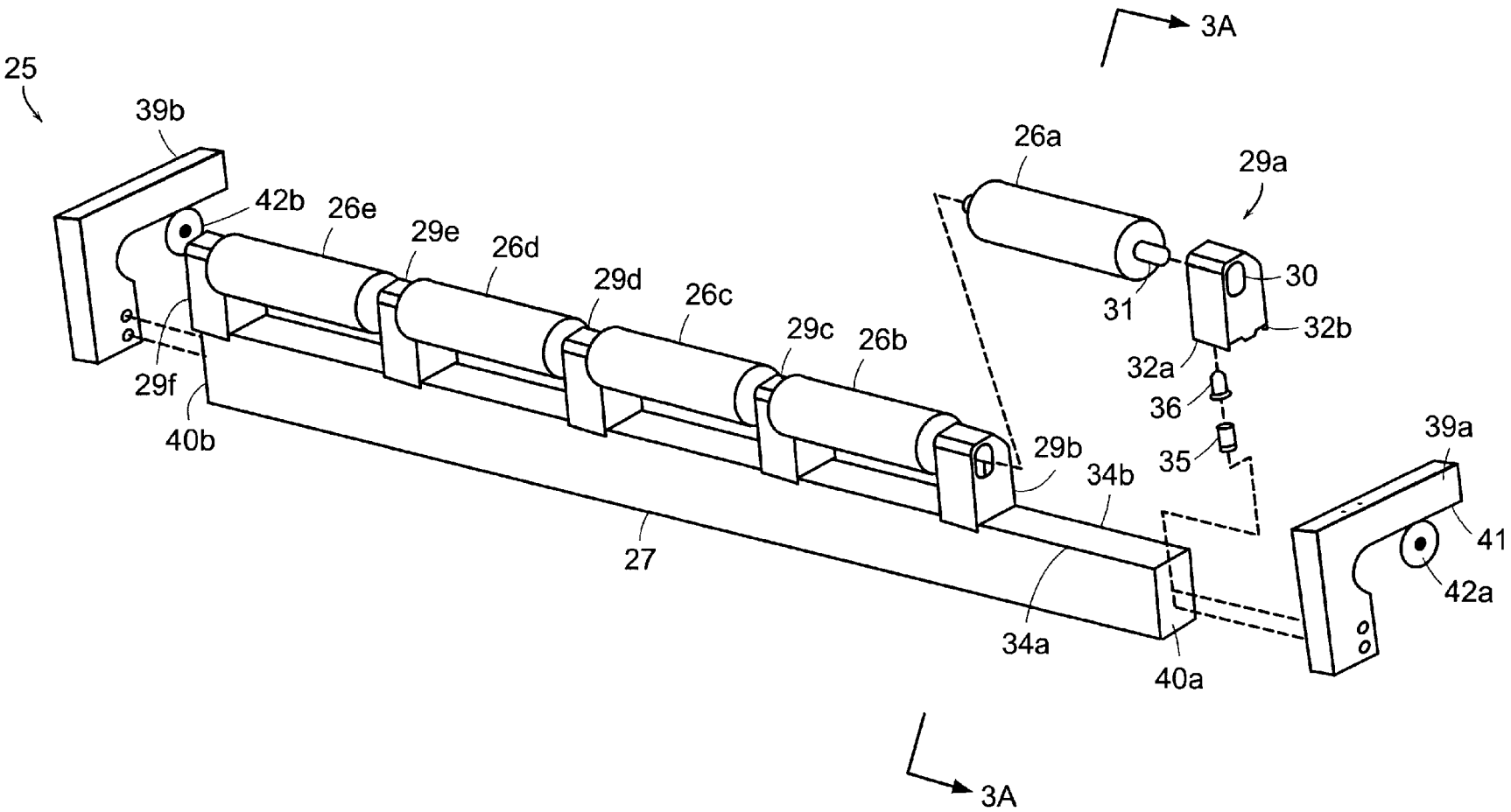
FIG. 2 is a perspective view of a pinch roller assembly, including a mechanism which controls an amount of force applied by pinch rollers in the assembly.

Referring to FIG. 2, a view of these mechanisms in a pinch roller assembly 25 is shown. Pinch roller assembly 25 includes plural pinch rollers 26*a* to 26*e,* each of which is mechanically coupled to member 27. When so coupled, pinch rollers 26*a* to 26*e* move in concert with member 27, thus moving as a single roller, more or less. Pinch rollers 26*a* to 26*e* contact a single capstan roller (not shown in FIG. 2) when the pinch force is applied (via member 27, see below); however, multiple capstan rollers may also be used.

The mechanical coupling to member 27 is the same for all of pinch rollers 26*a* to 26*e;* therefore, it will only be described with respect to pinch roller 26*a*. Pinch roller 26*a* is coupled to mounting blocks 29*a* and 29*b,* which do not interfere with conveying of the recording medium. These mounting blocks have a common design; therefore, only one mounting block 29*a* is described. Mounting block 29*a* includes a hole 30 which receives a shaft 31 of pinch roller 26*a,* thereby allowing pinch roller 26*a* to rotate relative to mounting block 29*a*. Flanges 32*a* and 32*b* on mounting block 29*a* align with sides 34*a* and 34*b,* respectively, on member 27 to align the mounting block to member 27. Mounting block 29*a* is fixed to member 27 using screws or the like.

Internal to mounting block 29*a* is an assembly comprised of a spring 35 and a plunger 36. Spring 35 is interposed between member 27 and plunger 36. Plunger 36 contacts spring 35 and shaft 31, and moves laterally (e.g., "up" and "down") relative to pinch roller 26*a* as force is applied to pinch roller 26*a*. Spring 35 restricts the motion of plunger 36 (and thus the motion of pinch roller 26*a* ), while still providing pinch roller 26*a* with some freedom of lateral movement relative to the recording medium during the application of a pinch force.

As shown in FIG. 2, pinch roller 26*a,* mounting block 29*a,* and member 27 are in a common mechanical coupling with (L-shaped) bar 39*a*. Bar 39*a* is fixed (via screws or the like) to a side 40*a* of member 27. A similar such bar 39*b* is fixed to an opposite side 40*b* of member 27. Bars 39*a* and 39*b* operate identically; therefore, only bar 39*a* is described.

In contact with the underside 41 of bar 39*a* is cam 42*a* (bar 39*b* contacts a similar cam 42*b*). Cam 42*a* is movable (that is, rotatable) relative to bar 39*a* to leverage bar 39*a* and, in turn, member 27, mounting blocks 29*a* to 29*f,* and pinch rollers 26*a* to 26*e*. This leverage causes pinch rollers 26*a* to 26*e* to move into closer (that is, tighter) contact with the capstan roller, thereby increasing the amount of pinch force applied to a recording medium between the pinch rollers and the capstan roller.

Figure 3A:
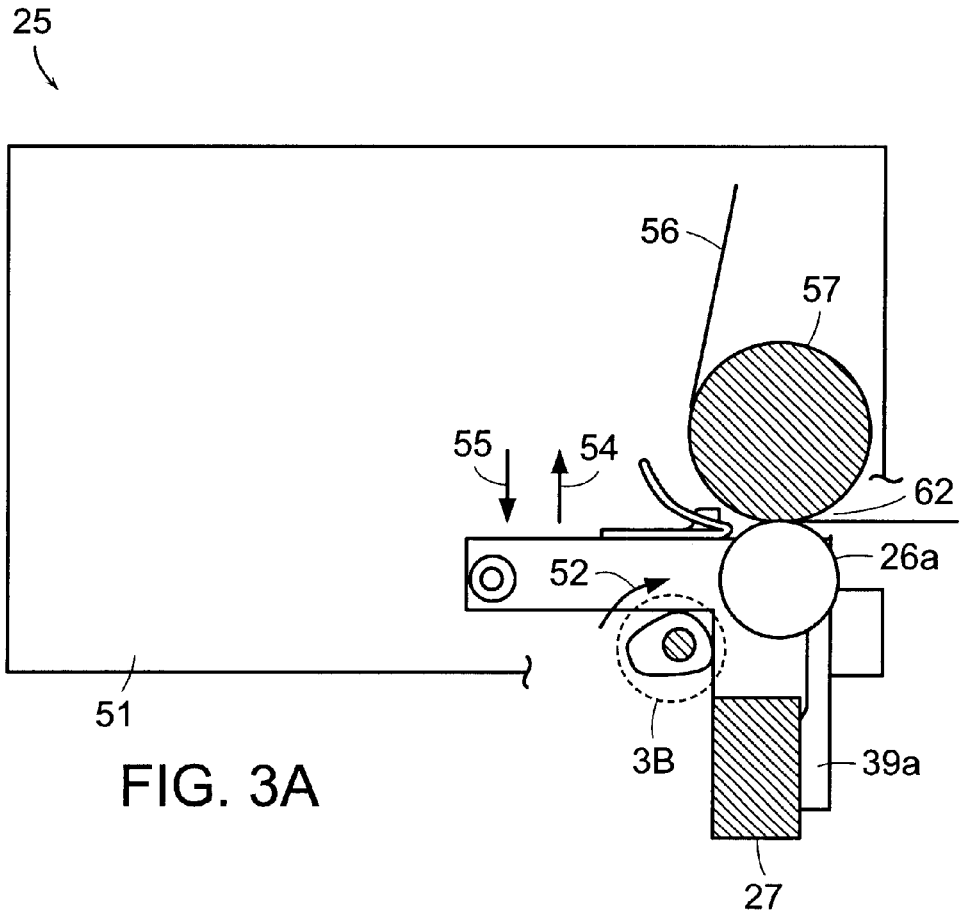
FIG. 3A is a sectional view of the pinch roller assembly.
Figure 3B:
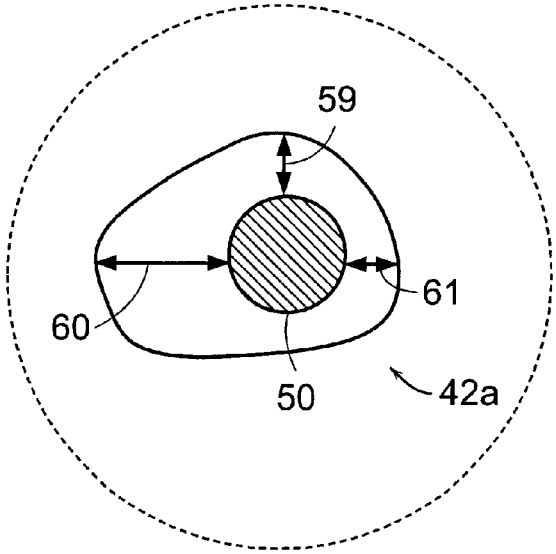
FIG. 3B is a sectional view of the controlling cam.

Referring to FIG. 3, a cut-away view of assembly 25 taken along line 3A–3A (FIG. 2) is shown. Cam 42*a* has a radius which varies relative to its center shaft 50. This center shaft is rotatable and fixed (to side plate 51, described below), meaning that center shaft 50 is laterally immobile relative to bar 39*a* but can rotate about its own axis (arrow 52). As center shaft 50 and thus cam 42*a* rotates, variations in the radius of cam 42*a* will cause bar 39*a* to move upwards (arrow 54) or downwards (arrow 55), depending upon which radius of cam 42*a* comes into contact with bar 39*a*. As bar 39*a* moves, so does member 27, mounting block 29*a,* and pinch roller 26*a,* thereby affecting the amount of pinch force applied to medium 56 by pinch roller 26*a* and capstan roller 57.

For example, if cam 42*a* is rotated to a position where radius 59 is in contact with bar 39*a* (as shown), a low (nonzero) pinch force will result (for use, e.g., with thin recording media) since radius 59 is relatively small. If cam 42*a* is rotated to a position where radius 60 is in contact with bar 39*a,* a higher (nonzero) pinch force will result (for use, e.g., with thick recording media) since radius 60 is relatively large. Cam 42*a* is also provided with a "media loading" radius 61. This radius is small relative to the remainder of cam 42*a* and, when cam 42*a* is rotated to a position where this radius 61 is in contact with bar 39*a,* a gap (or zero pinch force) will be produced between rollers 26*a* and 57. This gap is used to load new media to common area 62 between rollers 26*a* and 57.

Figure 4:
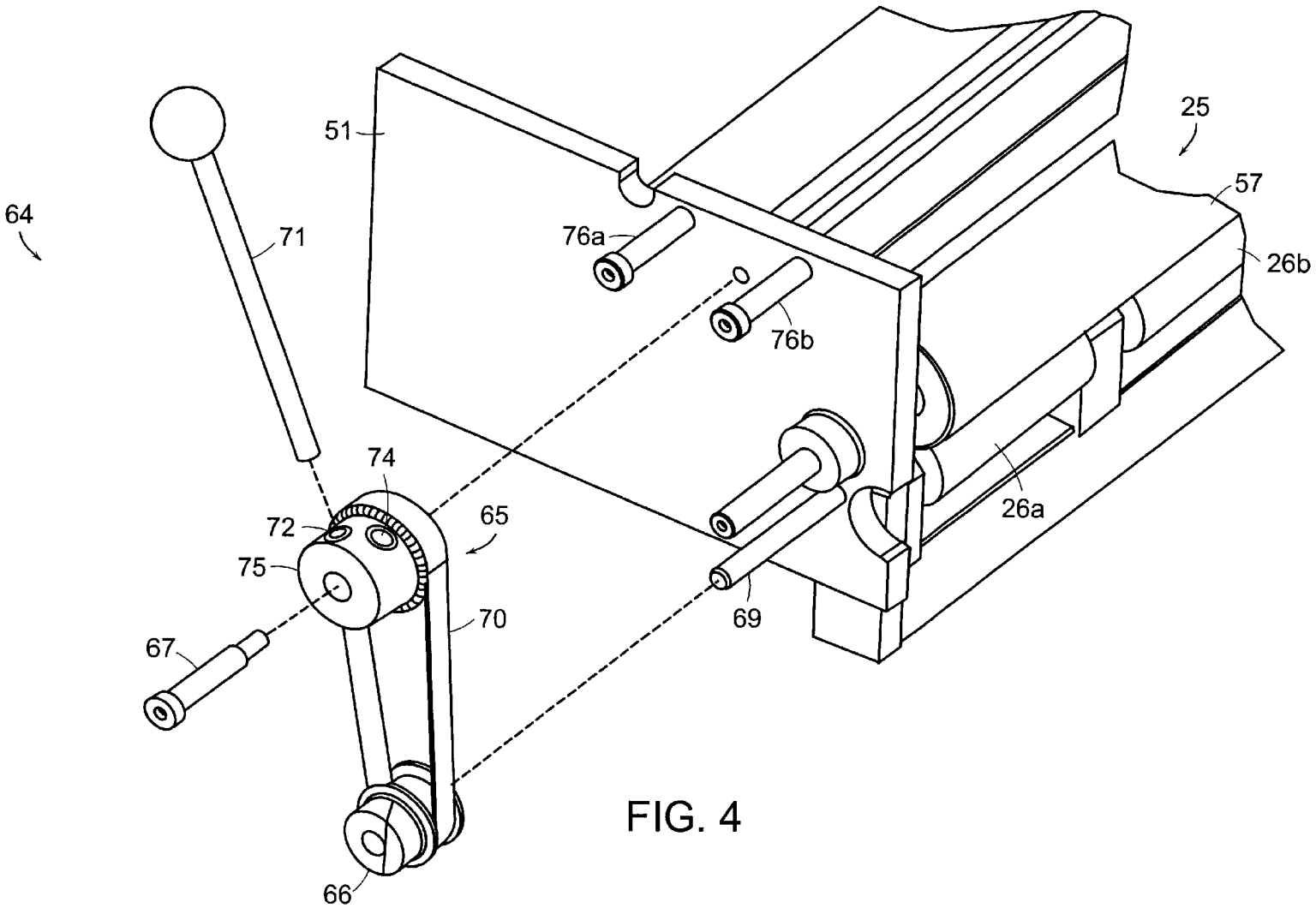
FIG. 4 is a perspective view of a mechanism for controlling the amount of applied pinch force.

Referring now to FIG. 4, a control mechanism 64 is shown for controlling cam 42*a* (cam 42*a* itself is not visible in FIG. 4) to leverage pinch rollers 26*a* to 26*e*. Control mechanism 64 is connected to side plate 51, which is interposed between assembly 25 (FIG. 2) and electro-mechanical devices (not shown) for controlling the rotation of capstan roller 57 (the pinch rollers are passive in that they rotate when capstan roller 57 rotates).

Control mechanism 64 includes a master gear 65 and a slave gear 66, which are mounted to shafts 67 and 69, respectively, on side plate 51. Shaft 67 is fixed. Master gear 65 rotates around shaft 67 and slave gear 66 rotates shaft 69 to rotate the cam. Slave gear 66 is mounted on the center shaft (shaft 69) of the cam, which protrudes from side plate 51. A belt 70 connects master gear 65 to slave gear 66, and thus couples the motion (rotation) of master gear 65 to slave gear 66. Belt 70 may include teeth (not shown) which mate to corresponding teeth (also not shown) on master gear 65 and slave gear 66. In operation, rotating master gear 65 causes slave gear 66 to rotate which, in turn, causes the cam to rotate (since slave gear 66 is coupled to the center shaft of the cam).

A lever 71 is provided for controlling rotation of master gear 65 manually (and thus for changing the amount of pinching force). Receptacles 72 and 74 (e.g., holes) are provided on an outer portion 75 of master gear 65 for receiving lever 71. When mated to one of these receptacles, lever 71 is used to control rotation of master gear 65.

Figure 5:
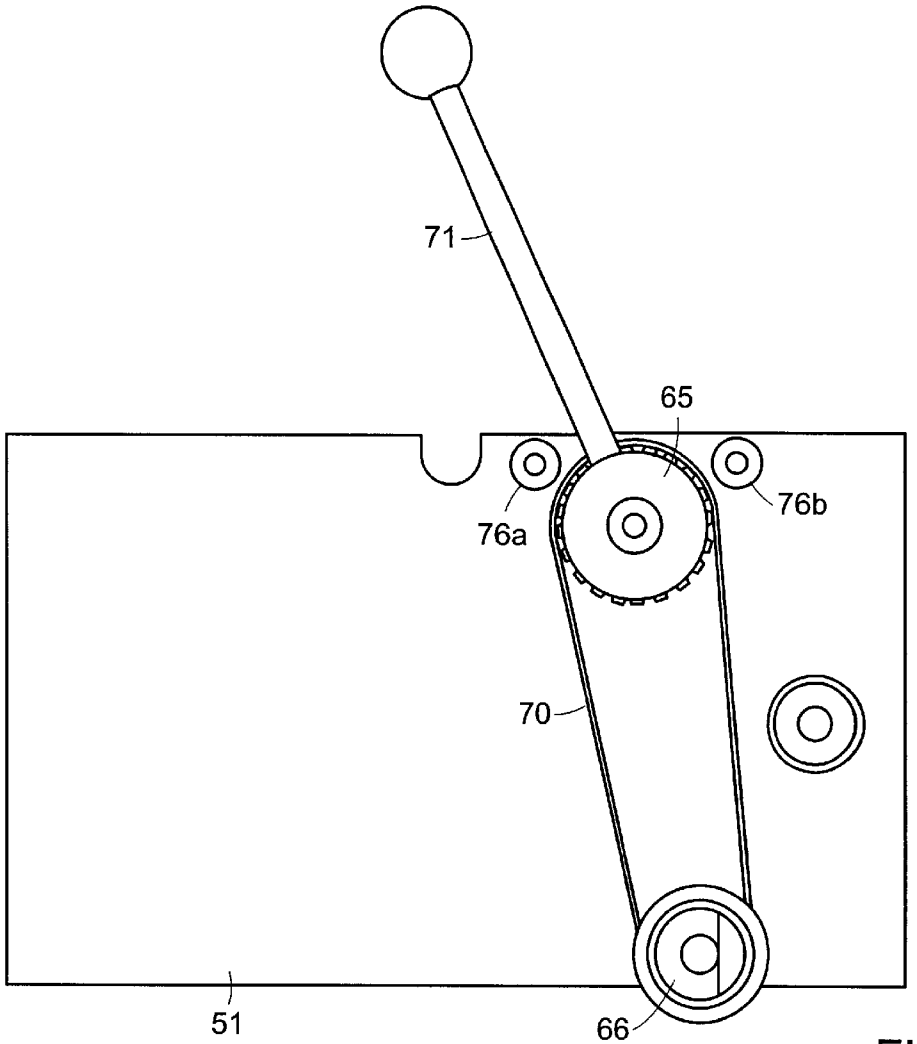
FIG. 5 is a side view of the mechanism of FIG. 4.

As shown in FIGS. 4 and 5, mechanical stops 76*a* and 76*b* are arranged relative to lever 71 for limiting the range of rotation of the lever (and thus of master gear 65, slave gear 66, and the cam). Mechanical stops 76*a* and 76*b* and receptacles 72 and 74 are arranged so that, when lever 71 is mated to receptacle 74, cam 42*a* can be rotated between radius 60 (high pinch force) and radius 61 (media load) (FIG. 3); and, when lever 71 is mated to receptacle 72, cam 42*a* can be rotated between radius 59 (low pinch force) and radius 61. Thus, by moving lever 71 from one receptacle to another, it is possible to change, and/or control, the amount of the pinch force manually.

Other embodiments not described herein are also included within the scope of the following claims. For example, more than two receptacles may be provided on outer portion 75 of master gear 65. These additional receptacles would provide additional pinch force variations. Lever 71 could be mated to outer portion 75 differently. For example, lever 71 could be mated to a track on outer portion 75 which includes plural slots (similar to a manual gear shift). The lever could be moved along the track into (or out of) these slots to vary the amount of applied force. Such a configuration eliminates the need to remove lever 71 to reset the amount of force. Also, additional radii could be provided on the cam, again to provide further pinch force variations. The invention could be incorporated into a variety of different types of imaging systems using any type of recording medium, and is not limited to the specific configurations set forth above.

What is claimed is:

1. An apparatus which conveys a recording medium, comprising:

first and second rollers which define a common area through which the recording medium is conveyed, the first and second rollers contacting the recording medium in the common area and rotating in concert to convey the recording medium from the common area; and a cam having at least three surfaces each having a different radius, the cam leveraging the second roller to vary an amount of force applied to the recording medium in the common area.

2. The apparatus of claim 1, wherein the common area is defined by surfaces of the first and second rollers.

3. The apparatus of claim 1, wherein the cam is movable into plural positions, each of the plural positions for leveraging the second roller differently to change the amount of force.

4. The apparatus of claim 1, further comprising a control mechanism for controlling the cam to leverage the second roller.

5. The apparatus of claim 4, wherein the control mechanism comprises:

a first gear connected to the cam;

a second gear connected to the first gear by a belt which couples motion of the first gear to the second gear, the second gear including a receptacle; and a lever which mates to the receptacle and which is movable to control motion of the second gear.

6. The apparatus of claim 5, wherein:

the second gear includes plural receptacles; and the lever is capable of mating to each of the plural receptacles, the lever controlling motion of the second gear to apply a first range of force when mated to a first one of the plural receptacles, and the lever controlling motion of the second gear to apply a second range of force when mated to a second one of the plural receptacles.

7. The apparatus of claim 5, further comprising mechanical stops arranged relative to the lever for limiting a range of motion of the lever.

8. The apparatus of claim 1, further comprising:

a bar arranged in a common mechanical coupling with the second roller;

wherein the cam is in contact with the bar and is movable relative to the bar to leverage the second roller.

9. The apparatus of claim 1, wherein the first roller comprises a capstan roller and the second roller comprises a pinch roller.

10. The apparatus of claim 1, further comprising:

a member which is in a common mechanical coupling with plural pinch rollers including the second roller; and a bar which couples to the member and which is in contact with the cam;

wherein the cam is rotatable relative to the bar to leverage the plural pinch rollers via the bar and the member.

11. The apparatus of claim 10, further comprising:

a second cam located on an opposite side of the member as the first cam; and a second bar which couples to the member and which is in contact with the second cam;

wherein in the second cam is rotatable relative to the second bar to leverage the plural pinch rollers via the second bar and the member.

12. The apparatus of claim 1, further comprising:

a mounting block which is coupled to the second roller;

a member which is coupled to the mounting block; and a bar which is coupled to the member and which is in contact with the cam;

wherein the cam is rotatable relative to the bar to leverage the second roller via the bar, the member, and the mounting block, and wherein the mounting block includes a spring in contact with the member and the second roller for controlling motion of the second roller during leveraging.

13. A laser imaging system which includes the apparatus of claim 1.

14. The apparatus of claim 1, wherein the cam which leverages the second roller to vary an amount of force applied to the recording medium between a first nonzero force, a second nonzero force, and a zero force.

15. An apparatus for conveying a recording medium, comprising:

conveying means for conveying the recording medium, the conveying means applying an amount of force to the recording medium; and changing means for changing the amount of force from a first nonzero force to a second nonzero force, the changing means including a cam having plural surfaces each having a different radius, wherein a first one of the plural surfaces provides the first nonzero force and a second one of the plural surfaces provides the second nonzero force.

16. The apparatus of claim 15, further comprising controlling means for controlling the changing means manually.

* * * * *